US009555526B1

(12) United States Patent
Gauthier et al.

(10) Patent No.: US 9,555,526 B1
(45) **Date of Patent: *Jan. 31, 2017**

(54) SELECTIVELY LOCKABLE TORQUE-LIMITING MECHANISM

(71) Applicant: Gauthier Biomedical, Inc., Grafton, WI (US)

(72) Inventors: Michael T. Gauthier, Grafton, WI (US); Robert F. Miller, Grafton, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/317,307

(22) Filed: Jun. 27, 2014

Related U.S. Application Data

(60) Provisional application No. 61/841,027, filed on Jun. 28, 2013.

(51) Int. Cl.

| | |
|---|---|
| ***B25B 23/157*** | (2006.01) |
| ***B25B 23/142*** | (2006.01) |
| ***B25B 23/14*** | (2006.01) |
| *B25B 21/00* | (2006.01) |
| *B25B 15/02* | (2006.01) |

(52) U.S. Cl.
CPC ..... *B25B 23/1427* (2013.01); *B25B 23/14* (2013.01); *B25B 23/142* (2013.01); *B25B 15/02* (2013.01); *B25B 21/00* (2013.01)

(58) Field of Classification Search
CPC .... B25B 23/141; B25B 23/1427; B25B 15/02; B25B 23/14; B25B 21/00
USPC ..... 81/473–475
See application file for complete search history.

(56) References Cited

U.S. PATENT DOCUMENTS

| | | | | |
|---|---|---|---|---|
| 1,566,553 | A | | 12/1925 | Maisch |
| 1,860,871 | A | | 5/1932 | Pouliot |
| 2,332,971 | A | | 10/1943 | Johnson |
| 2,732,746 | A | | 1/1956 | Livermont |
| 2,802,354 | A | | 8/1957 | Bohnhoff et al. |
| 3,001,430 | A | * | 9/1961 | Cranford ..... 81/474 |
| 3,167,936 | A | | 2/1965 | Engquist |
| 3,168,944 | A | | 2/1965 | Livermont |
| 3,277,670 | A | | 10/1966 | Bent |
| 3,277,671 | A | | 10/1966 | Winstone et al. |
| 3,305,058 | A | | 2/1967 | Orwin et al. |
| 3,542,162 | A | | 11/1970 | Durnell et al. |
| 3,613,751 | A | | 10/1971 | Juhasz |

(Continued)

*Primary Examiner* — Hadi Shakeri
*Assistant Examiner* — Danny Hong
(74) *Attorney, Agent, or Firm* — Boyle Fredrickson, S.C.

(57) ABSTRACT

A tool including selectively operable torque-limiting mechanism is provided. The tool includes a housing, a torque-limiting mechanism disposed within the housing and including a first gear engaged with the housing and including a number of first recesses, a second gear rotatably disposed within the housing adjacent the first gear and including a number of second recesses, a number of bearings disposed between the first gear and the second gear partially within the first recesses and partially within the second recesses, and a variable force-applying assembly engaged with the first gear opposite the second gear, a drive body engaged with the second gear and extending outwardly from the housing, and a cover disposed around the housing and selectively engaged with the drive body to control the operation of the torque-limiting mechanism.

11 Claims, 13 Drawing Sheets

(56) References Cited

U.S. PATENT DOCUMENTS

| | | | | | |
|---|---|---|---|---|---|
| 3,653,226 | A | | 4/1972 | Westbury | |
| 3,702,546 | A | | 11/1972 | Schnepel | |
| 3,942,337 | A | | 3/1976 | Leonard et al. | |
| 4,041,729 | A | * | 8/1977 | Bilz | 192/56.5 |
| 4,262,501 | A | | 4/1981 | Vaughn et al. | |
| 4,668,206 | A | | 5/1987 | Fukumoto | |
| 4,712,456 | A | | 12/1987 | Yuan | |
| 4,901,610 | A | | 2/1990 | Larson et al. | |
| 5,035,311 | A | | 7/1991 | Girguis | |
| 5,054,588 | A | | 10/1991 | Thorp et al. | |
| 5,069,091 | A | * | 12/1991 | Bramsiepe et al. | 81/177.7 |
| 5,156,244 | A | | 10/1992 | Pyles et al. | |
| 5,239,875 | A | * | 8/1993 | Stasiek et al. | 73/862.23 |
| 5,356,350 | A | | 10/1994 | Schreiber | |
| 5,383,818 | A | | 1/1995 | Lessat-Kaupat et al. | |
| 5,505,676 | A | | 4/1996 | Bookshar | |
| 5,881,613 | A | | 3/1999 | Han | |
| 6,076,439 | A | * | 6/2000 | Dzieman | 81/473 |
| 6,132,435 | A | | 10/2000 | Young | |
| 6,155,147 | A | * | 12/2000 | Dzieman | 81/473 |
| 6,312,339 | B1 | | 11/2001 | Bevert | |
| 6,640,674 | B1 | | 11/2003 | Rinner et al. | |
| 6,752,051 | B2 | | 6/2004 | Hu | |
| 6,832,533 | B1 | | 12/2004 | Huang | |
| 6,990,877 | B1 | | 1/2006 | Wu | |
| 7,013,769 | B2 | | 3/2006 | Chen | |
| 7,197,968 | B2 | | 4/2007 | Bubel | |
| 7,243,581 | B1 | | 7/2007 | Gao | |
| 7,272,998 | B1 | | 9/2007 | Gauthier | |
| 7,272,999 | B2 | * | 9/2007 | Cutler et al. | 81/475 |
| 7,334,509 | B1 | * | 2/2008 | Gao | 81/475 |
| 7,650,821 | B2 | * | 1/2010 | Gauthier et al. | 81/473 |
| 7,810,416 | B2 | * | 10/2010 | Cutler et al. | 81/467 |
| 8,714,056 | B2 | * | 5/2014 | Landowski | 81/474 |
| 2010/0204703 | A1 | * | 8/2010 | Gao | 606/104 |
| 2012/0055296 | A1 | * | 3/2012 | Landowski | 81/474 |

* cited by examiner

SELECTIVELY LOCKABLE TORQUE-LIMITING MECHANISM

CROSS-REFERENCE TO RELATED APPLICATIONS

This application claims priority from U.S. Provisional Application Ser. No. 61/841,027, filed on Jun. 28, 2013, the entirety of which is expressly incorporated by reference herein.

FIELD OF THE INVENTION

The present invention relates to tools used to rotate and/or drive fasteners, and more specifically to a torque-limiting mechanism for use with these types of tools.

BACKGROUND OF THE INVENTION

With regard to hand-held and powered tools used to drive features into or out of an item, especially those used in medical applications, there are several common problems associated with tools incorporating existing torque-limiting devices. These problems include loss of consistent torque value after repeated autoclave sterilization cycles, internal components breaking due to high forces and loads on internal cams and gears, inconsistent torque values due to wear on internal components, a strong recoil or snap when set at higher torque values, and difficulty in servicing the mechanism.

More particularly, as shown in FIGS. 20 and 21, in prior art torque-limiting devices, the devices include gears 100, 101 including a number of generally angular teeth 102 disposed along one side of the gears 100, 101. Each tooth 102 includes an angled sliding surface 104 and a flat, vertical locking surface 106 located between the sliding surfaces 104 of adjacent teeth 102. These gears 100, 101 are positioned in the mechanism with the teeth 102 facing one another in a manner where one of the gears 100 can rotate with respect to the other gear 101. This is due to the construction of the mechanism in which one gear 100 is fixed to mechanism and the other gear 101 can move with a drive body (not shown) for the tool to provide the torque-limiting function. When the tool incorporating the gears 100, 101 is subjected to a torquing force greater than a preset maximum, the moveable gear 101 rotates with respect to the fixed gear 100, such that the sliding surfaces 104 of the opposed teeth 102 slide against one another and urge the fixed gear 100 against a spring member (not shown) that biases the gears 100, 101 towards one another. The movable gear 101 can continue to rotate in response to the excessive torque until the flat locking surface 106 on the opposed teeth 102 are moved past the edges 105 of the sliding surfaces 104. In this position the gears 100, 101 move or snap back towards one another due to the bias of the spring member, and the respective flat surfaces 106 come into contact with one another to secure the gears 100, 101 in a camming position.

In order to enable the prior art mechanism to provide a closely controllable amount of torque resistance, the mechanism requires that the forces biasing the gears 100, 101 towards one another from: 1) the spring member; 2) the surface friction provided by the contact of the angled surfaces 104 on the opposed teeth 102 sliding with respect to one another; and 3) the drag of the gears 100, 101 on a housing (not shown) for the mechanism all be known and properly maintained. To enable the surface friction and drag to be controlled, a proper amount of lubrication is required to be present both on the teeth 102 and on the back of the rotatable gear 101 in contact with the housing in order to maintain the constant drag forces on the angled surfaces 104 and the movable gear 101. However, due to the cleaning and/or sterilization of tools including devices of this type, each sterilization cycle causes an inherent loss of the lubrication in the mechanism. As a result, the amount of surface friction and drag between the gears 100, 101 changes over time. This in turn drives the torque values up such that a consistent amount of torque resistance is not provided by the device.

Further, as a result of the particular shape of the teeth 102 on each gear 100, 101 the rotation of the gear 101 results in the locking surfaces 106 on each gears 100, 101 "snapping" into engagement with one another in both the axial and circumferential directions after passing one another. This movement of the locking surfaces 106 into engagement with one another necessarily creates vibrations in the mechanism which are transmitted through the mechanism and the tool incorporating the mechanism to the fastener and/or the person on which the device is being utilized. In many situations, these vibrations are highly undesirable. Also, the stress exerted on the surfaces 106 as they strike one another also leads to fracturing or chipping of the teeth 102, lessening the useful life of the mechanism. When the teeth 102 are chipped, this additional material can also collect on the sliding surfaces 104 of the teeth 102, thereby causing even more inconsistent torque values for the mechanism.

In addition, prior art torque limiting devices include one piece calibration nuts (not shown) that engage the spring members of the mechanism to calibrate or set the amount of torque necessary to rotate the gears 100, 101 with respect to one another. The calibration nut is normally secured to the mechanism by adhesives, by pairs of jam or locking nuts to reduce space and/or a mechanical interruption of threads to which the calibration nut is mounted. The design of each of these prior art calibration nut assemblies increases the complexity of the overall mechanism, and provides an additional manner in which the mechanism can break down.

Due to the multitude of problems associated with prior art torque limiting devices, it is desirable to develop or design a torque-limiting device which greatly reduces each of the problems associated with prior art devices at this time.

SUMMARY OF THE INVENTION

According to a one aspect of the present invention, a torque-limiting device for use in hand-held and power tools is provided in which the torque-limiting device includes a number of rolling ball bearings disposed partially within opposed pairs of recesses located in a pair of opposed gears that, in conjunction with springs acting on the gears and ball bearings, are utilized to control the movement and resistance to movement of the mechanism. The recesses in one of the gears are connected by a raceway along which the bearings can move between recesses when the mechanism is in operation. The use of the ball bearings and a raceway on one of the gears that the ball bearings can move along between the recesses enables the mechanism to be operated in a manner that greatly reduces the amount of variation over time of the preset torque values for the mechanism by reducing the wear experienced by the internal components controlling the actuating of the mechanism, and by avoiding the significant recoil or snap experienced by prior art mechanisms. This construction also greatly reduces the effects of varying levels of friction present in prior art mechanism by using ball bearings as the main friction generating members in the mechanism. The shape of the bearings creates much less overall friction, as well as a relatively constant amount of friction over extended periods of use of the mechanism, without the need for significant amounts of lubricants within the mechanism.

According to another aspect of the present invention, the ability of the mechanism to provide consistent torque values is also enhanced by the use of a split locking calibration nut that is securable to the mechanism in a simple manner, thereby avoiding the previous issues concerning the shifting of the nut and the consequent variation of the torque value applied by the mechanism. The calibration nut is threadedly engaged with a housing for the tool and with single locking nut that selectively positions the calibration nut within the housing to provide the desired amount of force against the springs that are used to determine the maximum torque level at which the mechanism will operate. By varying the position of the calibration nut, the amount of torque at which the mechanism slips can be set as desired, while the locking nut can maintain position of the calibration nut at this desired value. In addition to using a locking nut to hold the calibration nut in position, the calibration nut itself may include protrusions that are urged outwardly into engagement with the housing for the mechanism when the locking nut is engaged within the calibration nut. Thus, the calibration nut can be easily adjusted or removed in order to service the mechanism, without the need for disengaging any additional securing means, such as adhesive, or additional lock nuts as used in prior art mechanism.

According to still a further object of the present invention, a mechanism is enclosed within housing having a cover secured to the housing in an easily removable manner. The cover also includes an access cap that can be removed from the cover to enable the mechanism to be serviced without having to completely disassemble the mechanism. Further, the access cap engages the cover in a manner that prevents the cover from being inadvertently disengaged from the housing while the tool including the mechanism is in use.

According to still another aspect of the present invention, cover can be attached to the housing in a manner that allows the cover to move relative to the housing to enable the cover to function as a locking member for the mechanism. Thus, the cover can be moved from one position where the mechanism functions normally to another position where the cover operably locks the gears to one another, thereby disabling the operation of the mechanism.

Numerous other advantages, features, and objects of the present invention will remain apparent from the following detailed description taken together with the drawing figures.

BRIEF DESCRIPTION OF THE INVENTION

In the drawings:

The drawings illustrate the best mode currently contemplated of practicing the present invention.

DETAILED DESCRIPTION OF THE INVENTION

Figure 3:
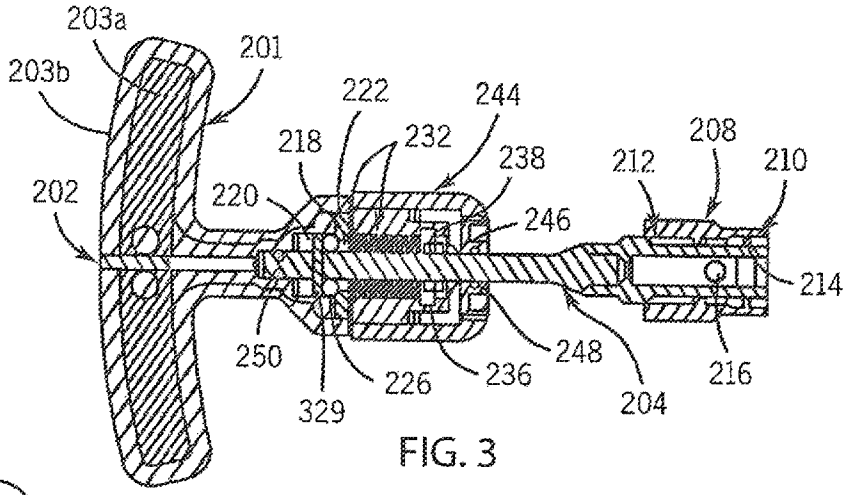
FIG. 3 is a cross-sectional view along line 3-3 of FIG. 2.
Figure 2:
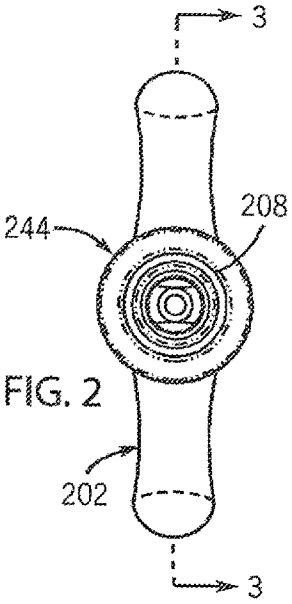
FIG. 2 is an end plan view of the device of FIG. 1.
Figure 1:
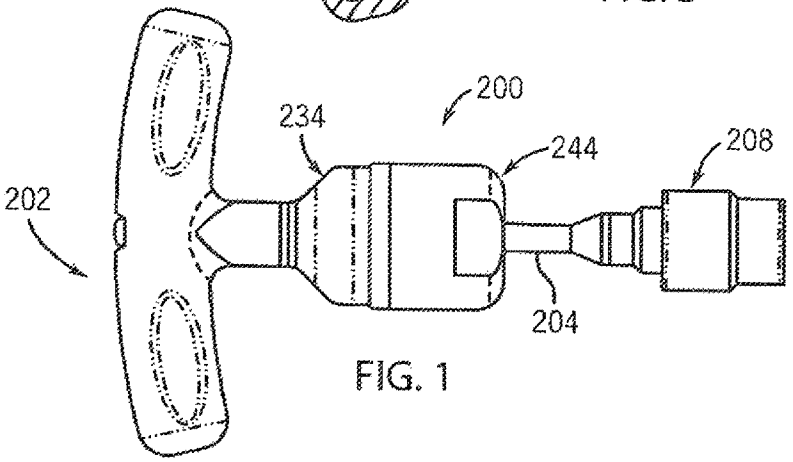
FIG. 1 is a side plan view of a first embodiment of a tool including the torque-limiting mechanism constructed according to the present invention.
Figure 4:
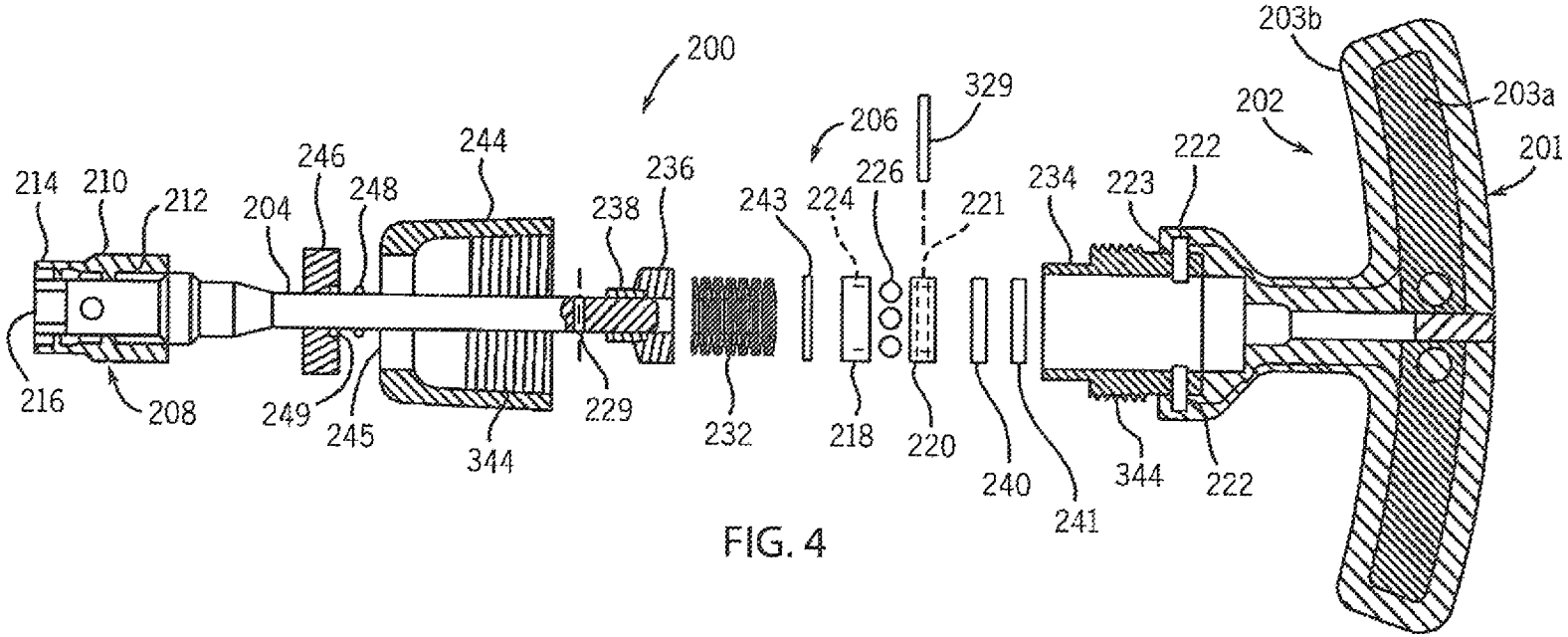
FIG. 4 is an exploded, cross-sectional view of the device of FIG. 1.

With reference now to the drawing figures in which like reference numerals designate like parts throughout the disclosure, a tool including a torque-limiting mechanism constructed according to the present invention is indicated generally at 200 in FIGS. 1-4. The tool 200 can be virtually any type of hand-held or power-driven tool that is used to apply torque to a driven member, e.g., a fastener, but in a preferred embodiment, is a hand-held torque wrench that includes a handle 202 with a gripping part 201 operatively connected to a drive body 204 extending outwardly from the handle 202 by the torque-limiting mechanism 206. The handle 202 is preferably formed of a suitably rigid, but relatively lightweight material, such as a light metal or plastic, to reduce the weight of the tool 200. Also, the handle 202 can be formed to have any desired configuration, and may include on the gripping part 201 an inner portion 203*a* formed of a more rigid material, and an outer portion 203*b* of a more flexible material to increase the ease of use of the tool 200.

The drive body 204 is preferably an elongate member that is used to transfer the torque applied to the tool 200 via the handle 202, or motor (not shown) in power-driven tool embodiments, to the fastener to be rotated, such as a screw, engaged by the drive body 204 opposite the handle 202. The drive body 204 is formed of a generally rigid material, such as a metal or hard plastic, and is preferably circular in cross-section, but can be formed to have other cross-sectional configurations as desired. Opposite the mechanism 206, the drive body 204 supports a connector 208. The connector 208 can have any desired configuration for releasably retaining thereon a suitable fastener-engaging implement (not shown), but in one embodiment best shown in FIGS. 3 and 4, includes a locking collar 210 slidably secured to the exterior of the connector 208 by a spring 212 and retaining ring 214. When the collar 208 is urged against the bias of the spring 212 towards the drive body 204, a retaining ball 216 on the connector 208 is moved out of the interior of the connector 208. This enables the implement to be inserted into the interior of the connector 208 without interference from the retaining ball 216. When the collar 210 is released, allowing the collar 210 on the connector 208 to return to its original position due to the bias of the spring 212, the retaining ball 216 is urged by the collar 210 back into the interior of the connector 208 into engagement with an aligned recess (not shown) in the implement, thereby securing the implement within connector 208.

Figure 5:
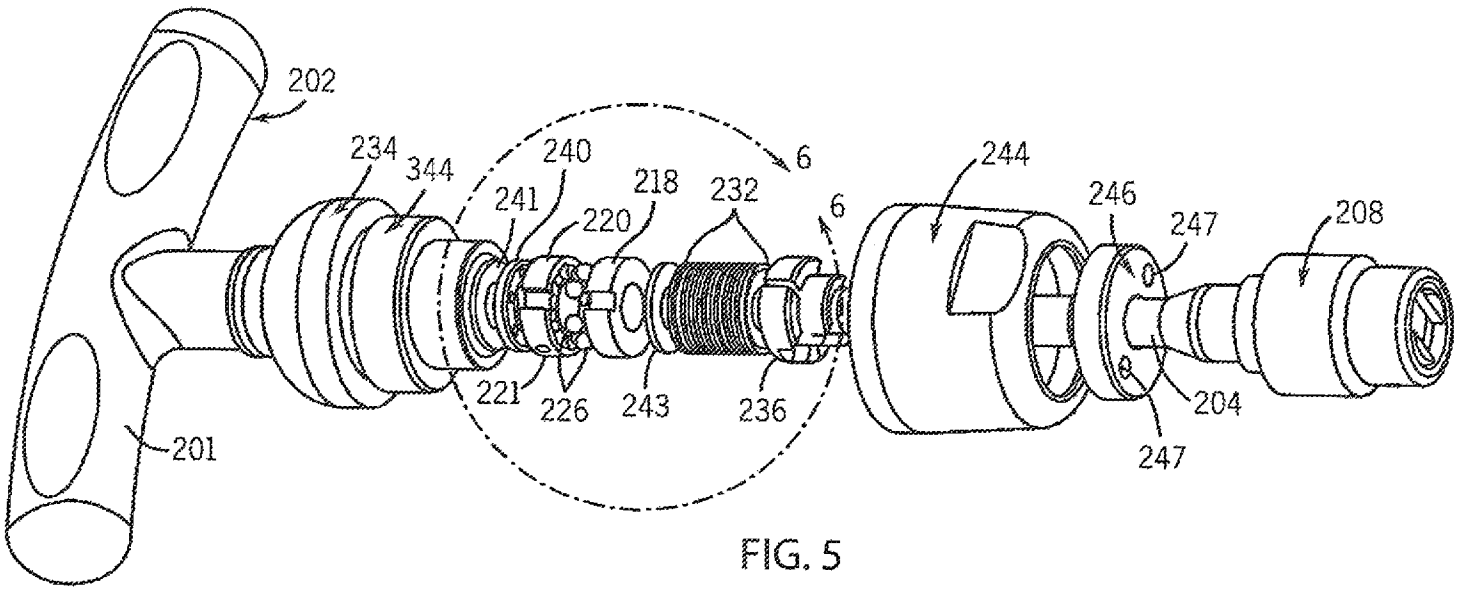
FIG. 5 is an exploded, isometric view of the mechanism of FIG. 1.
Figure 6:
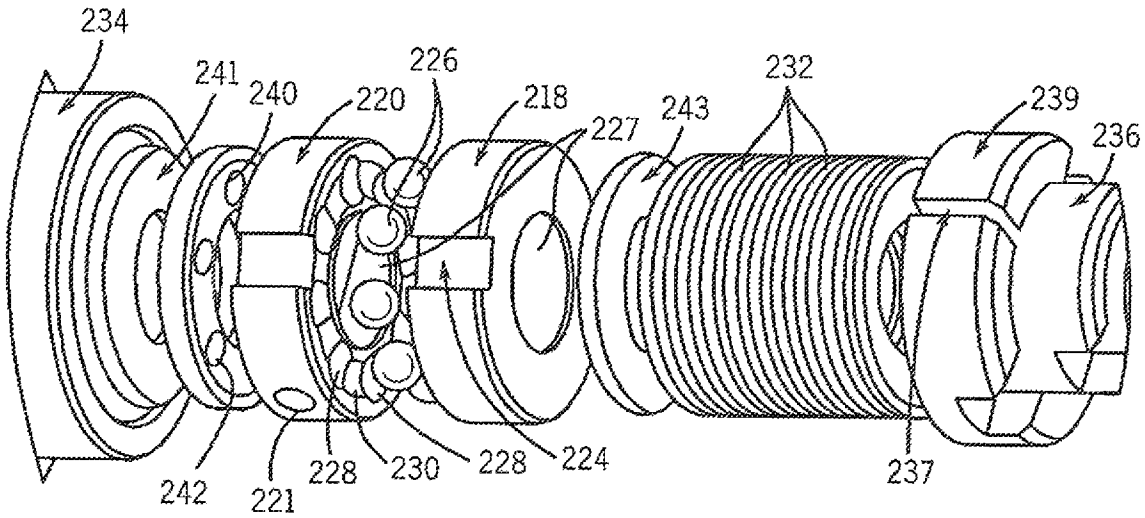
FIG. 6 is a partially broken away, exploded view along line 6-6 of FIG. 5.
Figure 7:
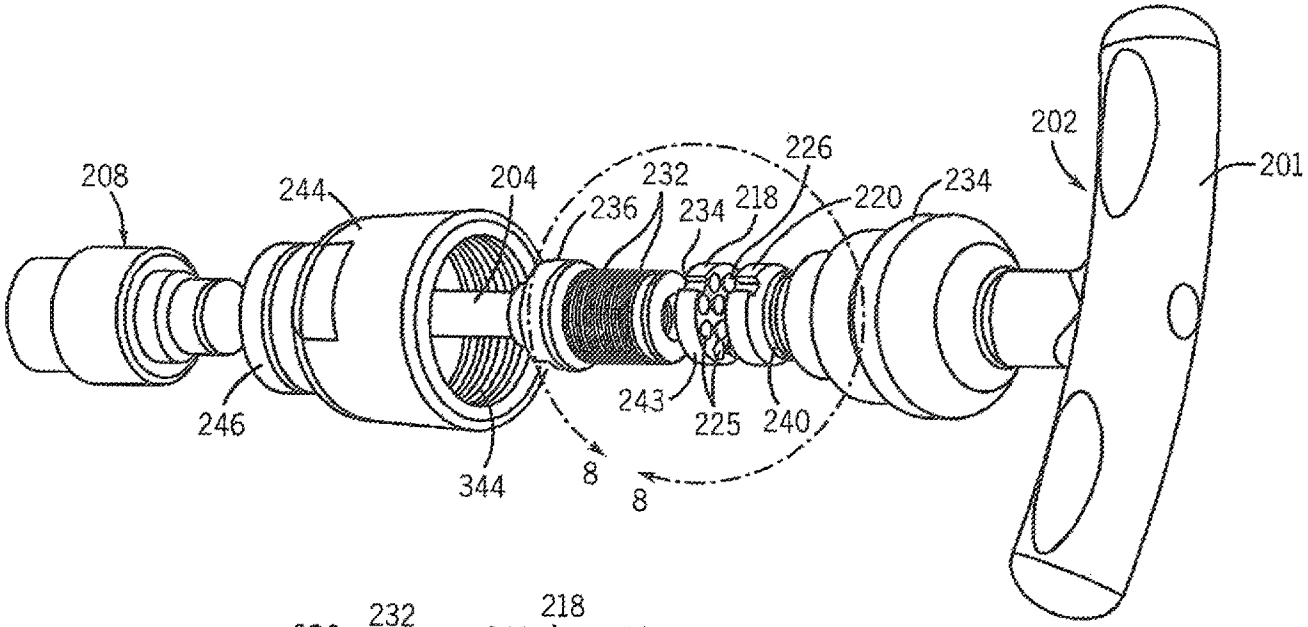
FIG. 7 is an exploded, isometric view of the mechanism of FIG. 5 in a direction opposite FIG. 5.
Figure 8:
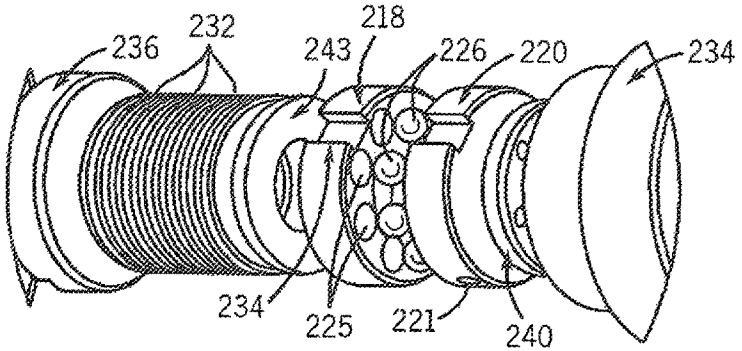
FIG. 8 is a partially broken away, exploded view of the mechanism along line 8-8 of FIG. 7.
Figure 11:
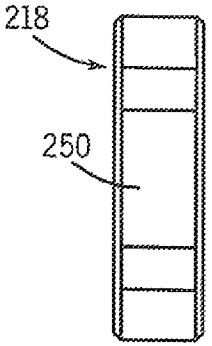
FIG. 11 is a side plan view of the fixed gear of FIG. 9.
Figure 10:
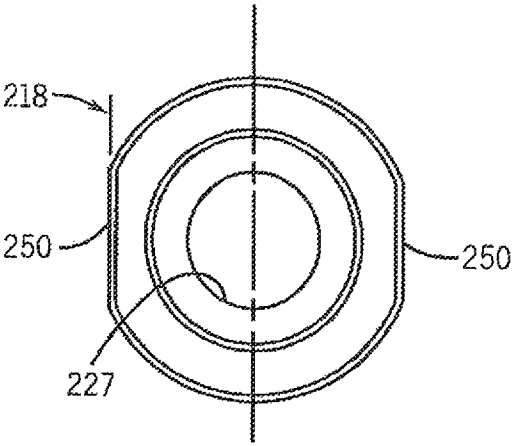
FIG. 10 is a top plan view of the fixed gear of FIG. 9.
Figure 9:
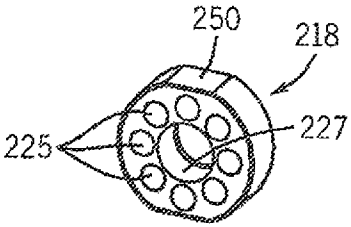
FIG. 9 is an isometric view of a second embodiment of the fixed gear of the mechanism of FIG. 1.
Figure 14:
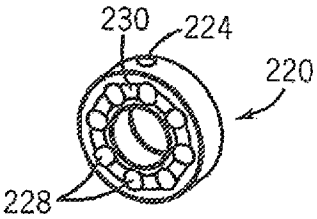
FIG. 14 is an isometric view of the slip gear of the device of FIG. 1.
Figure 13:
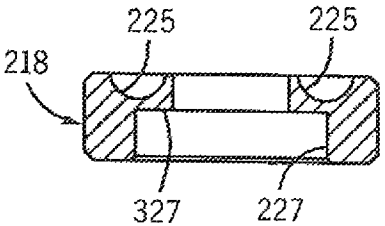
FIG. 13 is a cross-sectional view along line 13-13 of FIG. 12.
Figure 12:
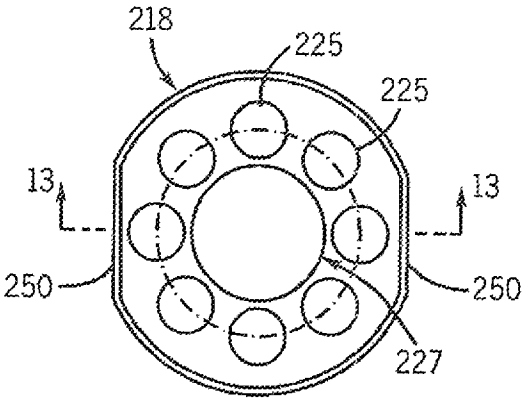
FIG. 12 is a bottom plan view of the fixed gear of FIG. 9.
Figure 17:
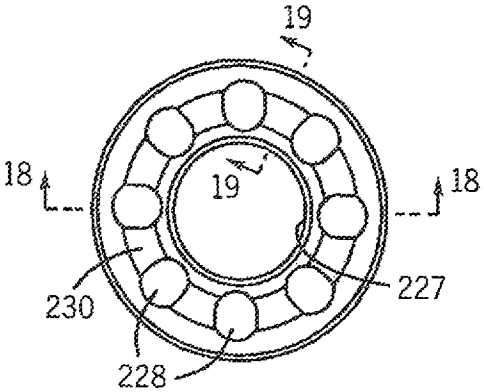
FIG. 17 is a top plan view of the slip gear of FIG. 14.
Figure 16:
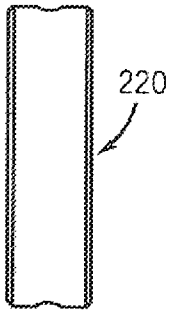
FIG. 16 is a side plan view of the slip gear of FIG. 14.
Figure 15:
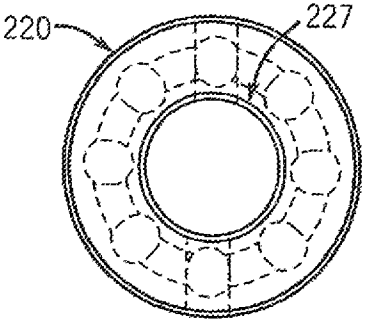
FIG. 15 is a bottom plan view of the slip gear of FIG. 14.
Figure 19:
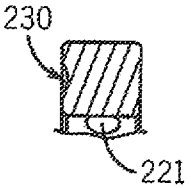
FIG. 19 is a cross-sectional view along line 19-19 of FIG. 17.
Figure 18:
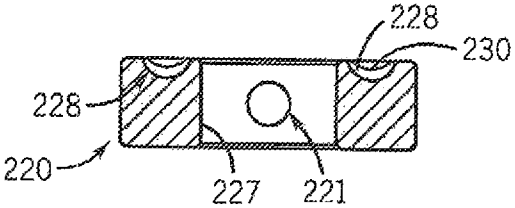
FIG. 18 is a cross-sectional view along line 18-18 of FIG. 17.
Figure 20:
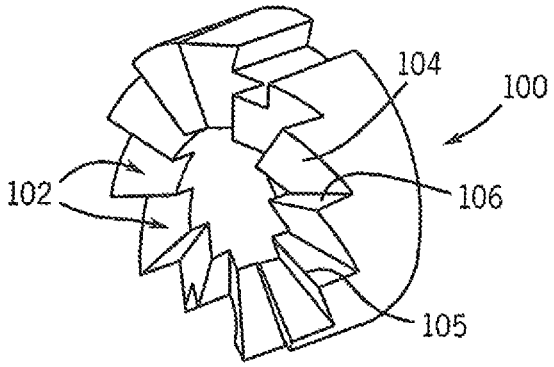
FIG. 20 PRIOR ART
FIG. 20 is an isometric view of a fixed gear used in a prior art torque-limiting mechanism.
Figure 21:
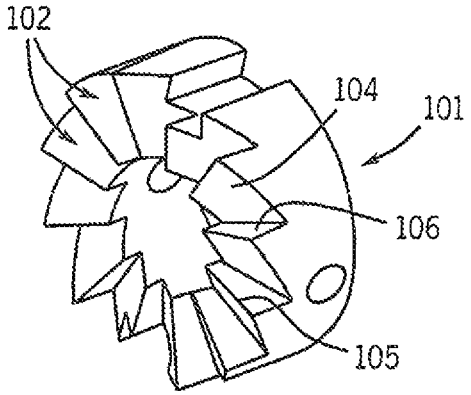
FIG. 21 PRIOR ART
FIG. 21 is an isometric view of a slip gear used with the prior art fixed gear of FIG. 20.

Referring now to FIGS. 3-19, the torque-limiting mechanism 206 includes a pair of gears 218, 220 formed of a rigid material, such as a metal, or hard plastic that are positioned generally opposite one another within the mechanism 206. The gear 218, best shown in FIGS. 5-8 is a fixed gear secured within a generally cylindrical housing 234 attached to or integrally formed with one end of the handle 202 opposite the gripping part 201. The fixed gear 218 is preferably secured within the housing 234 by a pair of locking pins 222 that extend through the housing 234 into connection with the gear 218. The pins 222 extend through bores 223 in the housing 234 into slots 224 formed on opposite sides of the gear 218 to prevent rotation of the gear 218 within the housing 234. In an alternative embodiment, best shown in FIGS. 9-13, the fixed gear 218 can be formed with a pair of flats 252 on opposite sides of the gear 218 that are engaged with similarly shaped flat surfaces (not shown) located on the interior surface of the housing 234. The flats 252 take the place of the pins 222 and slots 224 to hold the fixed gear 218 in position within the housing 234 to enable the transfer of torque from the handle 202 to the fixed gear 218.

The fixed gear 218 also includes a number of dimples 225 spaced around a central opening 227 in the gear 218 on one surface of the fixed gear 218. The opening 227 can be cylindrical or can define an annular shoulder 327 therein to assist in the formation of the dimples 225. A number of generally spherical ball bearings 226 are disposed partially within the dimples 225 and are able to rotate therein. The depth of the dimples 225 in the gear 218 is preferably sufficient to receive approximately one half of the volume of each bearing 226, such that while the bearings 226 can rotate within the dimples 225, the bearings 226 are each maintained within the dimples 225. In a particularly preferred embodiment, the bearings 226, which are formed of a rigid and smooth material, such as a metal, are formed to have a diameter slightly less than the diameter of the dimples 225. This allows the bearings 226 to rotate more freely within the dimples 225 when the tool 200 and mechanism 206 are in use and also enables the mechanism 206 to be assembled more easily.

The gear 220, i.e., the rotatable or slip gear, is also positioned within the housing 234 immediately adjacent the fixed gear 218 between the fixed gear 218 and the gripping part 201 of the handle 202. The slip gear 220, best shown in FIGS. 5-8 and 14-19, is formed similarly in shape and material to the fixed gear 218, with a central opening 227 and a number of dimples 228 spaced around the opening 227 on one side of the gear 220 that is positioned to face the dimples 225 in the fixed gear 218. The dimples 228 receive the end of each of the bearings 226 extending outwardly from dimples 225 in fixed gear 218, but are less deep than dimples 225 in the fixed gear 218. The slip gear 220 also includes an arcuate raceway 230 extending around the surface of the gear 220 along a circular centerline between the dimples 228. During operation of the mechanism 206, the bearings 226, while retained in dimples 225 on the fixed gear 218, can move along the raceway 230 in order to displace the bearings 226 between the respective dimples 228 as the slip gear 220 rotates with respect to the fixed gear 218 when a torque level above a pre-selected maximum is applied to the tool 200.

Additionally, the slip gear 220 includes a cross pin opening 221 that extends across and through the slip gear 220 generally perpendicular to the central opening 227. The opening 221 is positionable in alignment with a bore 229 formed in the drive body 204 in order to enable a cross pin 329 to be inserted through the opening 221 and bore 229 to secure the slip gear 220 to the drive body 204. Further, while the diameter of the bore 229 and opening 221 within which the pin 329 is received can be formed to closely conform to the outer diameter of the pin 329, in a preferred embodiment, the diameter of the opening 221 and bore 229 are formed to be greater than required for insertion of the pin 329. This gap created between the pin 329 and the opening 221 and bore 229 enables a certain amount of play between the drive body 204 and the slip gear 220, thereby providing a smoother feel to the mechanism 206. Additionally, in an attempt to further enhance the feel of the mechanism 206 and reduce the potential for unwanted drag or friction acting on the mechanism 206, in a preferred embodiment, the outer diameter of the slip gear 220 is selected to allow for a space between the outer periphery of the slip gear 220 and the interior surface of the housing 234, allowing the slip gear 220 to "float" within the housing 234, and not rub against the sides of the housing 234.

Referring now to FIGS. 3-8, to provide the torque level control for the mechanism 206, the fixed gear 218 and slip gear 220 are biased into engagement with the bearings 226 and one another by a number of biasing members or springs 232. The springs 232 can each be formed from any suitable biasing member or material, but are preferably formed as Belleville washers and are disposed within the housing 234. Each spring 232 is generally circular in shape with a central opening 235 through which the drive body 204 can extend and are disposed within the housing 234 against the fixed gear 218 opposite the slip gear 220. The springs 232 can be selectively compressed into engagement with one another and with the fixed gear 218 in order to provide the desired amount of force resisting the rotation of the gears 218, 220 and the bearings 226 with respect to one another during use of the tool 200.

In order to enable the force applied to the gears 218, 220 by the springs 232 to be varied as desired, an open end 235 of the housing 234 opposite the gripping portion 201 of the handle 202 is covered by a generally circular calibration nut 236 disposed around the drive body 204 in engagement with the springs 232 opposite the fixed gear 218. The calibration nut 236 preferably includes an expansion slot 237 that extends across the nut 236 and separates opposed portions 239 of the nut 236. The opposed portions 239 can be deflected away from one another and into engagement with the interior of the housing 234 to secure the nut 236 within the housing 234 and provide the desired force on the gears 218, 220 from the springs 232 by a tapered lock nut 238 also positioned around the drive body 204 and engaged between the body 204 and nut 236. To enable calibration nut 236 to be deflected, the nut 236, as well as the locking nut 238, is formed of a somewhat rigid material, such as a metal or hard plastic.

To utilize the calibration nut 236, the nut 236 is advanced into engagement with the springs 232 within the housing 234 until the desired spring force is exerted by the springs 232 against the gears 218, 220. In a preferred embodiment, the calibration nut 236 is advanced into the housing 234 by the engagement of exterior threads (not shown) on the nut 236 with interior threads (not shown) disposed on the interior of the housing 234. When the calibration nut 236 is positioned against the springs 232 at a location which provides the desired spring force to the gears 218, 220, the tapered lock nut 238 is engaged within the calibration nut 236 to urge the portions 239 of the nut 236 on opposite sides of the expansion slot 237 outwardly against the interior of the housing 234 and hold the calibration nut 236 in position. To further enhance the engagement of the calibration nut 236 with the housing 234, the nut 236 can include a number of a outwardly extending drive tangs (not shown) disposed on the exterior of the calibration nut 236 that engage the threads on the interior of the housing 234 in a manner to further prevent movement of the nut 236 with respect to the housing 234.

Looking now at FIGS. 5-8, to reduce any drag exerted by the inner housing 234 on the rotation of the slip gear 220, and to ensure that the force acting on the gears 218, 220 is limited as much as possible to only the force of the springs 232, the slip gear 220 is isolated from the inner end of the housing 234 by a hardened washer 241 and thrust bearing 240. The thrust bearing 240 includes roller bearings 242 therein that rotate within the thrust bearing 240 and contact the slip gear 220 to enable the slip gear 220 to rotate easily within the housing 234. A hardened washer 243 is also positioned between the springs 232 and the fixed gear 218 to enhance the frictional contact between the fixed gear 218 and the springs 232.

Look now at FIGS. 3-5 and 7, the interior components of the mechanism 206 described previously are enclosed within the housing 234 of the tool 200 by a generally cylindrical cover 244 that is releasably engaged with the exterior of the housing 234, such as by mating threads 344 on the exterior of the housing 234 and the interior of the cap 244. The cap 244 can be quickly and easily removed from the handle 202 in order to expose the mechanism 206 and enable the easy adjustment, service and/or replacement of any parts of the mechanism 206. The cover 244 defines a central opening 245 at an outer end thereof that receives an access cap 246 releasably secured to the cover 244 within the opening 245 around the drive body 204. The access cap 246 is fixed to the cover 244 by any suitable means in order to prevent the rotation of the cover 244 with respect to the housing 234, thereby preventing the inadvertent detachment of the cover 244 from the handle 202, such as during use of the tool 200. Preferably a number of fasteners (not shown) are engaged within bores 247 in the cap 246 to deflect the cap 246 into engagement with the cover 244 around the opening 245. The access cap 246 includes an O-ring 248 disposed around an inner opening 249 of the cap 246 that sealingly engages, but does not impede the rotation of the drive body 204 within the cap 246, in order to seal off the interior of the cover 244 and prevent the mechanism 206 from encountering any water, dust or other debris which can negatively affect the operation of the mechanism 206. A similar O-ring 250 can be disposed on the inner end of the drive body 204 located within the handle 202 to effectively seal the interior of the tool 200 to protect the components of the mechanism 206.

Other alternatives to the preferred embodiment described previously can be formed by changing the orientation of the fixed gear 218, slip gear 220 and springs 232 from the order of these components shown in the drawing Figs. Also, the location of the calibration nut 236 can also be altered depending upon the location of the springs 232, or can be positioned to engage the gears 218, 220 instead of the springs 232. Further, the bearing members 226 can be other than ball bearings, such as pin bearings, with corresponding changes to the shape of the dimples 225, 228 in the respective gears 218, 220. Additionally, the housing 234 can be formed separately from the handle 202 while the cover 244 can be formed as part of the handle 202.

In addition, in order to further provide a tool 200 with the ability to control the torque applied using the tool 200, another embodiment of the torque-limiting mechanism 206, each of the fixed gear 218 and the slip gear 220 can include teeth (not shown) positioned on the outer periphery of the gears 218 and 220. The teeth are spaced equidistant from one another around the periphery of each gear 218 and 220 in a form so as to be positioned in a one-way locking engagement when the gears 218 and 220 are assembled in the mechanism 206. In this configuration, the teeth, which each include a sloped friction surface (not shown) and a locking surface (not shown) similar to the teeth 102, oppose the rotation of the slip gear 220 with regard to the fixed gear 218 by the frictional engagement of the sloped surfaces and vertical surfaces of each of the teeth. However, as opposed to prior art gears 100, 101, the locking surfaces of the teeth are formed to be inclined from the vertical at an angle of between ten degrees (10°) to twenty-five degrees (25°), and preferably around fifteen degrees (15°), similar to the angle for the friction surfaces from the horizontal. The angle of the locking surfaces allow the teeth to slip more easily with regard to one another and prevent the snapping and vibrations caused by the shape of the teeth 102 in prior art gears 100, 101.

In an additional variation to the construction of the gears 218 and 220, it is possible to vary depth of dimples 225 and/or 228 to vary the amount of torque provided by the friction generated between the gears 218 and 220 and the bearings 226 without changing biasing or spring pressure provided by the particular springs 232 being utilized in the tool 200.

Further, as an alternative to the lock nut 238, it is possible to drill a hole (not shown) into the side of the housing 234 and insert therein a pin (not shown) through the side of the housing 234 to engage the calibration nut 236.

Figure 22:
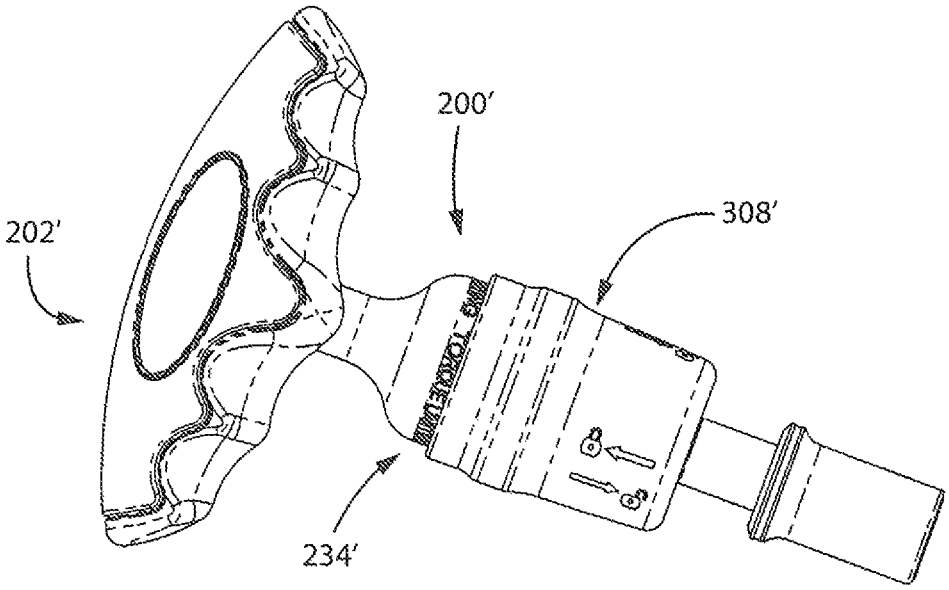
FIG. 22 is a top plan view of a third embodiment of a driving device constructed according to the present invention in an unlocked configuration.
Figure 26:
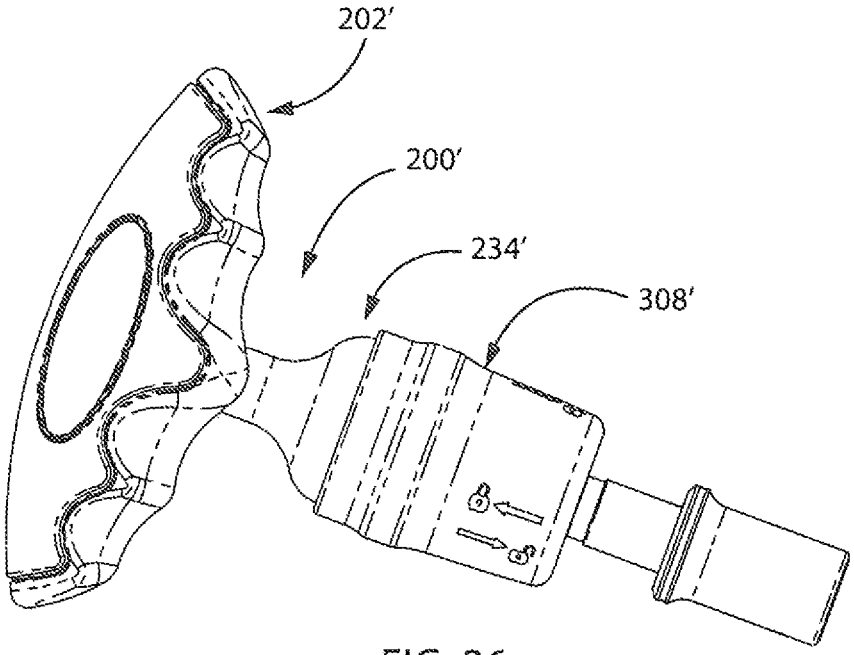
FIG. 26 is a top plan view of the device of FIG. 22 in a locked configuration.
Figure 23:
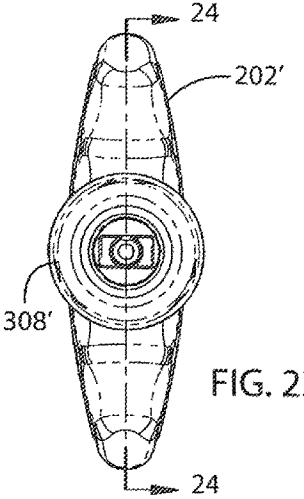
FIG. 23 is a front plan view of the device of FIG. 22.
Figure 24:
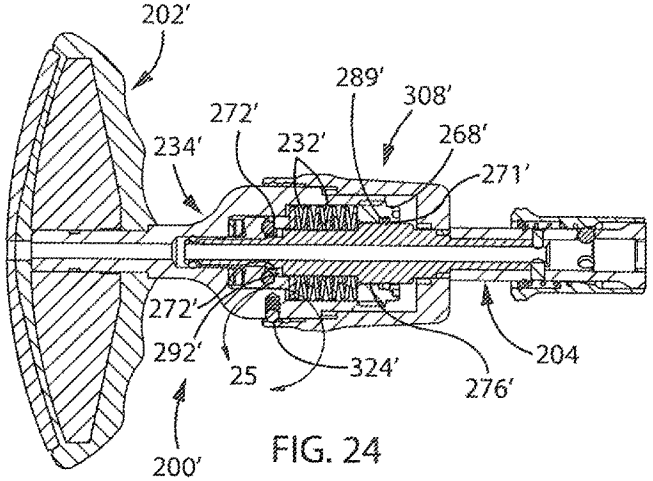
FIG. 24 is cross-sectional view along line 24-24 of FIG. 23.
Figure 25:
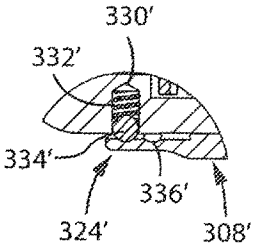
FIG. 25 is an enlarged view along line 25-25 of FIG. 24.
Figure 27:
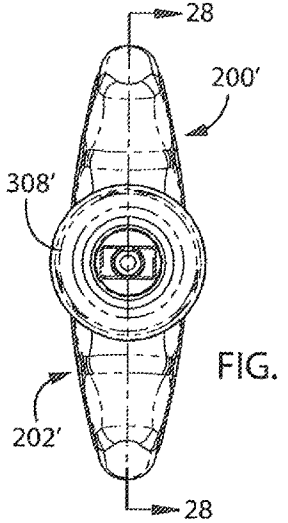
FIG. 27 is a front plan view of the device of FIG. 26.
Figure 28:
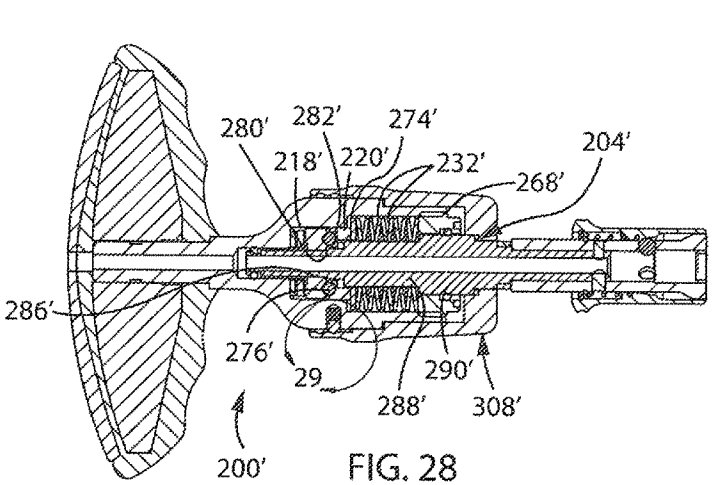
FIG. 28 is cross-sectional view along line 28-28 of FIG. 27.
Figure 29:
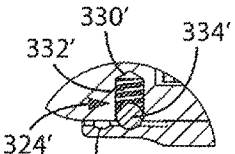
FIG. 29 is an enlarged view along line 29-29 of FIG. 28.

Looking now at FIGS. 22-29, a fifth embodiment of the tool 200' is illustrated that is formed similarly to the tool 200 and in which the housing 234' is formed to extend from the handle 202' to create a sleeve 260' that projects outwardly from the housing 234'. The gears 218' and 220', the springs 232' and apportion of the drive body 204' are disposed within the sleeve 260'. The sleeve 260' defines an inner portion 262' disposed adjacent the handle 202' and within which the main components of the torque limiting mechanism 206' are disposed, namely, the gears 218' and 220' and the bearings 226', and an outer portion 264' adjacent the inner portion 262' opposite the handle 202' within which the springs 232' are located. The diameter of the inner portion 262' is dimensioned to be slightly larger than the diameter of the gears 218' and 220' to enable one of the gears 218' or 220' to be fixed to the housing 234' and the other gear 218' or 220' to be fixed to the drive body 204'. Thus, the gear 218' or 220' fixed to the drive body 204' is able rotate within the inner portion 262' in conjunction with a suitable bearing 266' to operate the mechanism 206'.

The positioning of the gears 218' and 220' within the inner portion 262' positions the gear 218' or 220' opposite the handle 202' partially out of the inner portion 262' within the outer recess 264'. This enables this gear 218' or 220' to be engaged by the springs 232' located within the outer portion 264'. This allows the springs 232' to exert the desired force on the gears 218' and 220' to control the operation of the mechanism 206'. The desired force provided by the springs 232' is controlled by a locking nut 268' engaged with the housing 234' within an open end 270' of the sleeve 260', such as by threads or another suitable engagement mechanism, such that the nut 268' extends into the outer portion 264' of the sleeve 260' in engagement with the springs 232'. The position of the nut 268' on the drive body 204' further in the sleeve 260' increases the force exerted by the springs 232' by increasing the compression the springs 232', while positioning the nut 268' further out of the outer portion 264' lessens the compression of the springs 232'. The nut 268' also includes a radial recess 269' within which is disposed a sealing member 271', such as an O-ring, that is engaged with the drive body 204' to seal off the interior of the housing 234' and maintain the integrity of the operation of the mechanism 206'.

To enable the drive body 204' to extend into the housing 234' and be engaged and acted upon by the mechanism 206', the outermost of the gears 218' or 220', the springs 232' and the nut 268' each have a central aperture formed therein. The apertures 272' in the gear 218' or 220' has a diameter less than that of the apertures 274' in the springs 232' which have a diameter less than that of the aperture 276' in the nut 268'. The outermost of each of the apertures 272' and 274' contacts a corresponding shoulder 280' and 282' disposed on and defining separate diameter sections 286', 288' and 290' on the drive body 204'. The engagement of the shoulders 280' and 282' with the apertures 272' and 274' maintains the alignment of the drive body 204' within the sleeve 260' during operation of the tool 200'. In addition, the outermost gear 218' or 220' can include a recess 292' formed around the aperture 272' therein' that is disposed immediately adjacent the outer portion 264'. This recess 292' is dimensioned to receive a corresponding portion of the drive body 204' therein. The drive body 204' can rotate relative to the recess 292', but is maintained in alignment with the gear 220' and the remainder of the tool 200' by the recess 292', as well as other features of the tool 200', as described previously.

Figure 32:
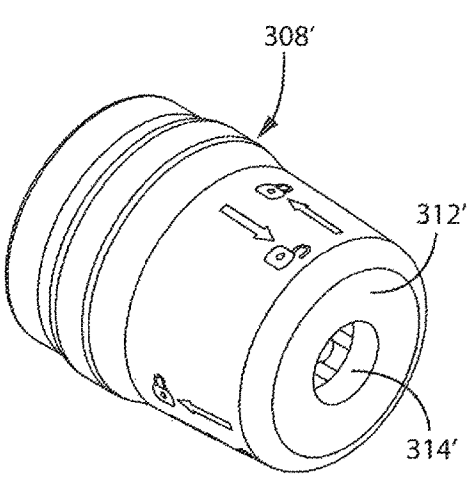
FIG. 32 is an isometric view of the locking collar of FIG. 30.
Figure 33:
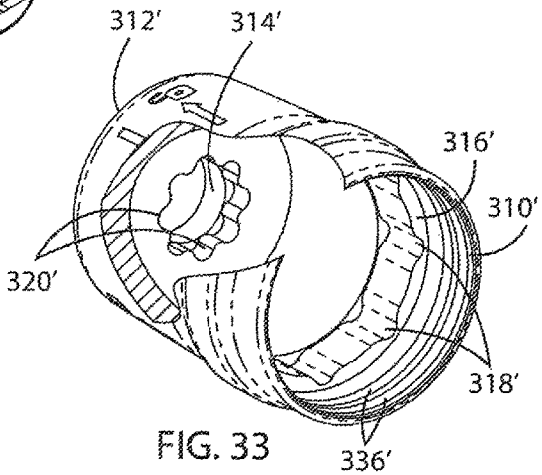
FIG. 33 is a partially broken away isometric view of the collar of FIG. 32.
Figure 30:
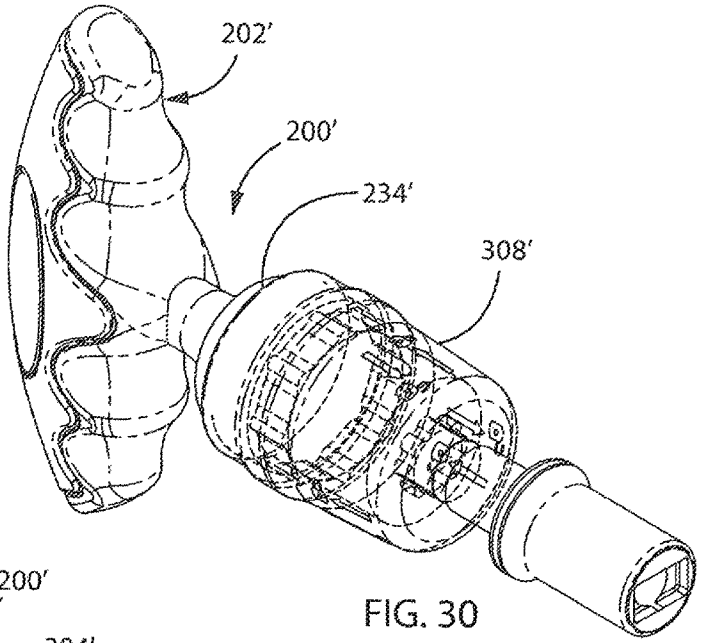
FIG. 30 is an isometric view of the device of FIG. 22.
Figure 31:
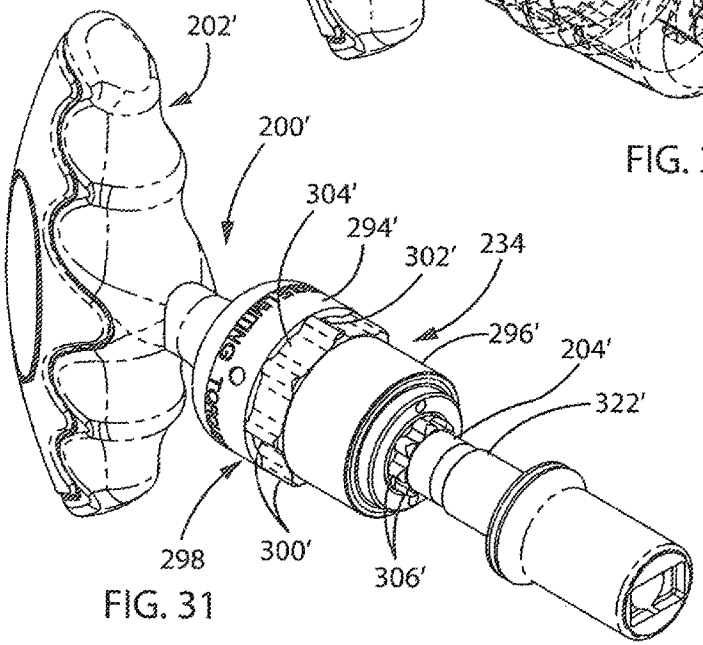
FIG. 31 is an isometric view of the device of FIG. 30 without the locking collar.

Referring now to FIGS. 22 and 30-33, the exterior surface of the housing 234' is formed with a wide inner section 294' and a narrow outer section 296'. The wide section 294' and the narrow section 296' are separated by a ring 298' having a number of ridges 300' thereon. In the illustrated embodiment, the ridges 300' are formed such that the tip 302' of each ridge 300' is positioned generally co-planar with the wide section 294', and with a number of spaces 304' located therebetween.

The section 290' of the drive body 204' is also formed to include ribs 306' shaped similarly to the ridges 300' located on the housing 234'. The ribs 306' in the illustrated embodiment are formed to be generally in radial alignment with the ridges 300'.

The ridges 300' and the ribs 306' are engaged by a cover 308' disposed over the housing 234'. The cover 308' is formed to conform to the shape of the housing 234' and in the illustrated embodiment is formed to be generally cylindrical in shape. The cover 308' defines an open end 310' positioned over and around the housing 234' and a closed end 312'. The closed end 312' includes a central opening 314' through which the drive body 204' can extend. The inner or interior surface 316' of the cover 308' is formed with a ring 316' spaced inwardly from the open end 312' and formed to be complementary to the ring 298' on the exterior of the housing 234' with a number of first notches 318' spaced around the interior of the ring 316' that can mate with the ridges 300' on the housing 234' to engage the cover 308' with the housing 234'. The cover 308' also includes a number of second notches 320' that are disposed in the periphery of the central opening 314'. The notches 320' in the illustrated embodiment extend partially through the opening 314' and are shaped complementary to the ribs 306' on the drive body 204' to engage the cover 308' with the drive body 204'. However, the notches 318' are formed with a length along the ring 316' that is greater than the length of the notches 320' around the central opening 314' for a purpose to be described.

Figure 36:
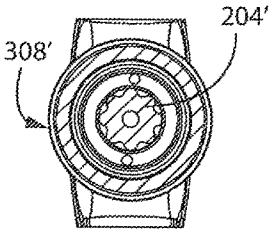
FIG. 36 is a cross-sectional view along line 36-36 of FIG. 34.
Figure 35:
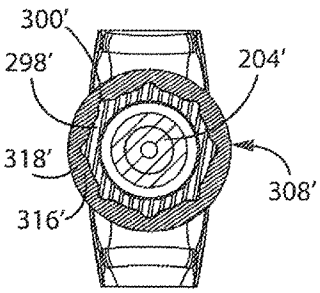
FIG. 35 is a cross-sectional view along line 35-35 of FIG. 34.
Figure 34:
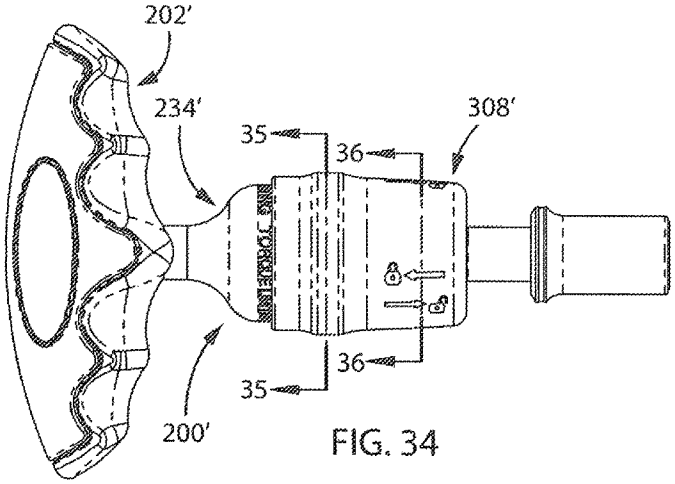
FIG. 34 is a top plan view of the device of FIG. 22.
Figure 39:
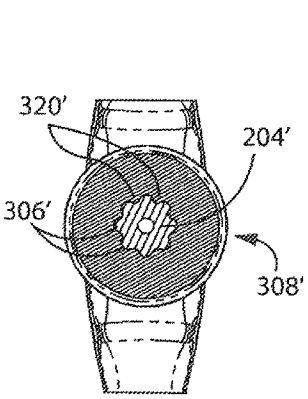
FIG. 39 is a cross-sectional view along line 39-39 of FIG. 37.
Figure 38:
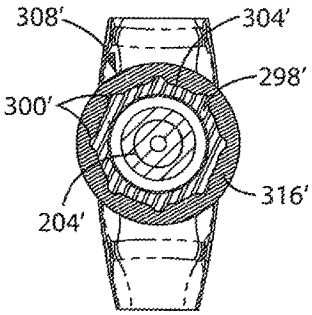
FIG. 38 is a cross-sectional view along line 38-38 of FIG. 37.
Figure 37:
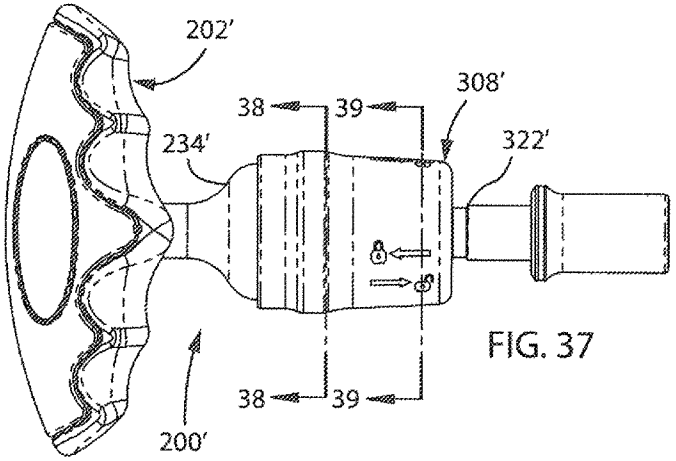
FIG. 37 is a top plan view of the device of FIG. 26.

Looking now at FIGS. 23-25, 27-29 and 34-39, the cover 308' is also positioned around the housing to be slidable with respect to the housing 234'. The cover 308' is maintained on the housing 234' at one end by a stop 322' formed on the drive body 204' and engageable with the closed end '312 of the cover 308' around the opening 314' and by a number of detents 324' engaged with the cover 308' generally opposite the closed end 312'.

The stop 322' is positioned on the outside of the main shaft 326' of the drive body 204' and has a diameter slightly larger than that of the opening 314'. Thus, when the cover 308' is moved away from the handle 202' the closed end 312' will strike the stop 322', thereby causing the motion of the cover 308' to stop at that point. In the illustrated embodiment, the stop 322' can be formed as a part of the shaft securing member 328' that is attached to the drive body 204' to enable drive implements (not shown) of various types to be engaged with the tool 200'.

The detents 324', which can be formed as a single detent 324' or multiple detents 324', with three detents 324' spaced equally around the housing 234', are formed in the wide section 294' of the housing 234' by a blind bore 330' formed in the wide section 294', a spring member 332' disposed in the bore 330' and a ball bearing 334' or other suitable structure disposed in the bore 330' to compress the spring 332' into the bore 330'. The spring 332' is selected to have a sufficient spring force to urge the bearing 334' out of the bore 330' and into engagement with one of a number of channels 336' formed on the interior of the cover 308' between the open end 310' and the ring 316'. The channels 336' are shaped to be generally complementary to the shape of the bearing 334', such that the bearing 334' can seat reliably within the channels 336'. Also, the channels 336' are positioned on the cover 308' to correspond to the positions of the cover 308' where the ridges 300' and ribs 306' are either fully engaged or fully disengaged by the notches 318' and 320'.

As best shown in FIGS. 23, 25, 27, 29, and 34-39, when the cover 308' is in the disengaged or unlocked position, the closed end 312' of the cover 308' is disposed against the stop 322' and the detent 324' is disposed in the channel 336' located closest to the open end 310'. In this position, the notches 320' are spaced from the ribs 306' but, due to longer length of the notches 318', the notches 318' are still engaged with the ridges 300' to maintain the alignment of the cover 308' with respect to the housing 234'. In this configuration, best shown in FIGS. 35 and 36, the cover 308' remains engaged with the housing 234' via the ridges 300' and notches 318', but is disengaged from the drive body 204' as a result of the separation of the notches 320' from the ribs 306'. This configuration for the mechanism 206' is able to function to allow for rotation of the drive body 204' separate from the handle 202' when a torque limit for the mechanism 206' is exceeded, thereby providing the torque-limiting function for the tool 200'.

Alternatively, when the cover 308' is slid into the locked position, an individual presses the cover 308' rearwardly towards the handle 202'. When the force exerted by the individual exceeds the spring force exerted by the spring member 332' on the bearing 334', the bearing 334' is moved into the bore 330' allowing the cover 308' to move towards the handle 202'. The cover 308' is then moved into the locked position where the ridges 300' are engaged with the notches 318', and also pressed against the wide section 294' of the housing 234' which functions as a stop for the cover 308' when moved to the locked position, and the ribs 306' are engaged by the notches 320'. In this position, best shown in FIGS. 38 and 39, the cover 308', via the engagement of the ribs 306' with the notches 320' on the drive body 204', locks the drive body 204' to the handle 202', such that the torque limiting mechanism 206' is rendered inoperative and the entire amount of torque applied to the handle 202' is transmitted through the drive body 204', even in excess of the maximum allowed by the mechanism 206'.

Figure 40:
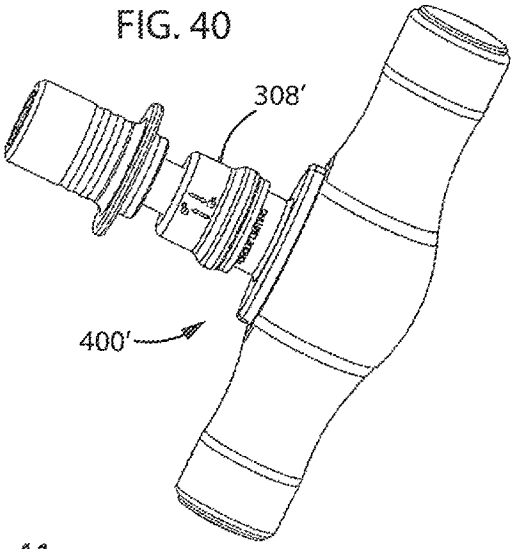
FIG. 40 is an isometric view of a fourth embodiment of a driving device constructed according to the present invention in an unlocked configuration.
Figure 41:
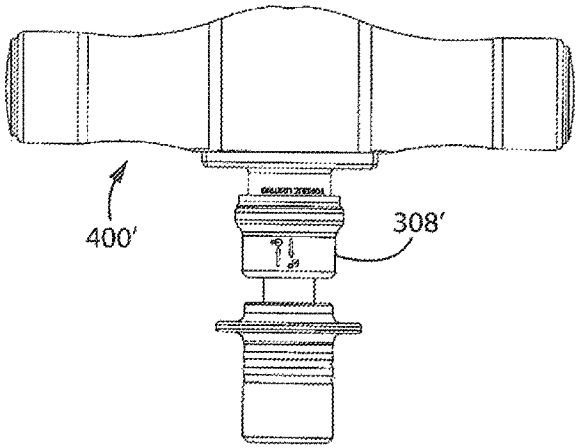
FIG. 41 is a side plan view of the device of FIG. 40.
Figure 42:
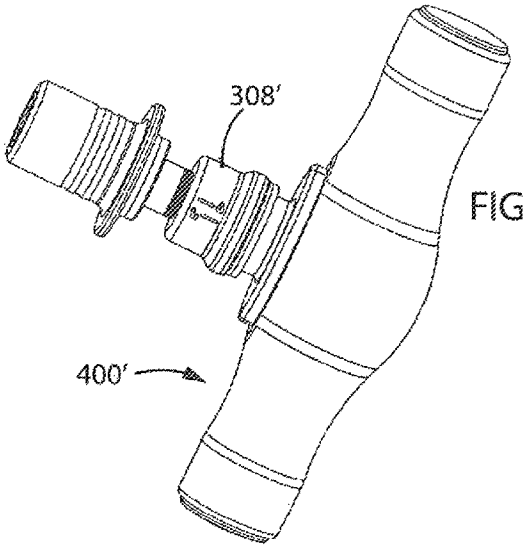
FIG. 42 is an isometric view of the device of FIG. 40 in a locked position.
Figure 43:
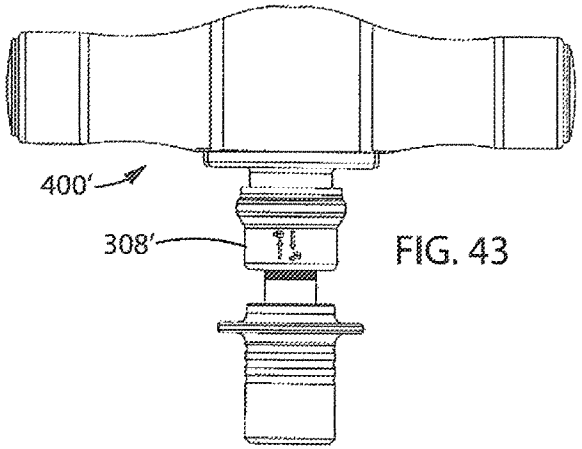
FIG. 43 is a side plan view of the device of FIG. 42.

In alternative embodiments, the mechanism 206' and the cover 308' can be configured for use with tools 200' having different configurations, such as a T-handle tool 400' having a torque-limiting mechanism therein, as shown in FIGS. 40-43, including those disclosed in U.S. Pat. Nos. 7,272,998; 7,430,945; 7,5650,821 and 7,913,594, which are each hereby incorporated by reference herein in their entirety.

Various additional alternatives are contemplated as being within the scope of the following claims particularly pointing out and distinctly claiming the subject matter regarded as the invention.

We hereby claim:

1. A tool including selectively operable torque-limiting mechanism, the tool comprising:

a) a housing;

b) a torque-limiting mechanism disposed within the housing;

c) a drive body engaged with the torque-limiting mechanism and extending outwardly from the housing;

d) a cover engaged with the housing and selectively engaged with the drive body to control the operation of the torque-limiting mechanism; and e) a number of ribs disposed on the exterior of the drive body that are engaged with a number of second notches on an interior surface of the cover, wherein the cover is slidably secured to the housing.

2. A method for controlling the operation of a tool including a torque-limiting mechanism, the method comprising the steps of:

a) providing the tool of claim 1; and b) adjusting the position of the cover with respect to the housing to selectively engage the cover with the drive body to place the torque-limiting mechanism in a locked or unlocked configuration.

3. A tool including selectively operable torque-limiting mechanism, the tool comprising:

a) a housing;

b) a torque-limiting mechanism disposed within the housing and including a first gear engaged with the housing and including a number of first recesses, a second gear rotatably disposed within the housing adjacent the first gear and including a number of second recesses, a number of bearings disposed between the first gear and the second gear partially within the first recesses and partially within the second recesses, and a variable force-applying assembly engaged with the first gear opposite the second gear;

c) a drive body engaged with the second gear and extending outwardly from the housing;

d) a cover disposed around the housing and selectively engaged with the drive body to control the operation of the torque-limiting mechanism; and e) a number of ribs disposed on the exterior of the drive body that are engaged with a number of second notches on an interior surface of the cover, wherein the cover is slidably secured to an exterior surface of the housing.

4. The tool of claim 3 further comprising a number of ridges disposed on the exterior of the housing that are engaged with a number of first notches on an interior surface of the cover.

5. The tool of claim 4 wherein the first notches are slidable with respect to the ridges.

6. The tool of claim 5 wherein the first notches remain engaged with the ridges at any position of the cover relative to the housing.

7. The tool of claim 3 wherein the second notches are slidable with respect to the ribs.

8. The tool of claim 7 wherein the second notches can be fully disengaged from the ribs.

9. The tool of claim 3 further comprising at least one defeat disposed on the housing and engageable with the housing.

10. The tool of claim 9, wherein the at least one detent is engageable with the cover to hold the cover in a locked or unlocked position with respect to the torque-limiting mechanism.

11. A method for controlling the operation of a tool including a torque-limiting mechanism, the method comprising the steps of:

a) providing the tool of claim 3; and b) adjusting the position of the cover with respect to the housing to selectively engage the cover with the drive body to place the torque-limiting mechanism in a locked or unlocked configuration.

* * * * *